US010023414B2

(12) United States Patent
Peccetti

(10) Patent No.: US 10,023,414 B2
(45) Date of Patent: Jul. 17, 2018

(54) AUTOMATIC CORE CHARGING AND BOBBIN DISCHARGING GROUP IN A PLASTIC FILM WINDING MACHINE

(71) Applicant: Eraldo Peccetti, Novara (IT)

(72) Inventor: Eraldo Peccetti, Novara (IT)

( * ) Notice: Subject to any disclaimer, the term of this patent is extended or adjusted under 35 U.S.C. 154(b) by 350 days.

(21) Appl. No.: 14/915,720

(22) PCT Filed: Sep. 12, 2014

(86) PCT No.: PCT/EP2014/002467
§ 371 (c)(1),
(2) Date: Mar. 1, 2016

(87) PCT Pub. No.: WO2015/043718
PCT Pub. Date: Apr. 2, 2015

(65) Prior Publication Data

US 2016/0200540 A1 Jul. 14, 2016

(30) Foreign Application Priority Data

Sep. 25, 2013 (IT) ..... MI2013A1576

(51) Int. Cl.
*B65H 19/30* (2006.01)

(52) U.S. Cl.
CPC ... *B65H 19/305* (2013.01); *B65H 2301/4148* (2013.01); *B65H 2301/41496* (2013.01);
(Continued)

(58) Field of Classification Search
CPC ..... B65H 19/30; B65H 19/305; B65H 2301/41824; B65H 2301/41726; B65H 2301/4148; B65H 2301/41496
See application file for complete search history.

(56) References Cited

U.S. PATENT DOCUMENTS 3,071,259 A 1/1963 Nystrand et al.
4,344,584 A * 8/1982 Schroeder ..... B65H 19/2223 242/533.4

(Continued)

FOREIGN PATENT DOCUMENTS

CN 201632426 U 11/2010
EP 0360948 A1 4/1990
EP 1306332 A2 5/2003

*Primary Examiner* — William A. Rivera
(74) *Attorney, Agent, or Firm* — Themis Law

(57) ABSTRACT

An automatic core-charging and bobbin-discharging group in a plastic film winding machine, positioned partially juxtaposed and partially below a winding reel includes a core charging portion having a motorized linear actuator carrying a guide-support which houses a certain number of cores suitable for receiving plastic film, the guide-support being movable, backwards and forwards, between a position associated with a core charger and a juxtaposed position, axially parallel to a spindle of the winding reel, with the cores inserted on the spindle, the linear actuator also being vertically liftable with a variation in an external diameter of the cores, and a bobbin discharging portion having a motorized conveyor belt, equipped with an extendable portion, movable between a position below a spindle carrying the wound bobbins and a discharging portion of the bobbins, the conveyor belt being vertically liftable with a variation in an external diameter of the bobbins.

9 Claims, 5 Drawing Sheets

(52) U.S. Cl.
CPC ..... *B65H 2301/41726* (2013.01); *B65H 2301/41824* (2013.01)

(56) References Cited

U.S. PATENT DOCUMENTS 4,588,138 A * 5/1986 Spencer ..... B65H 18/021 242/533.6
5,810,966 A * 9/1998 Semba ..... B65H 19/2215 156/188
5,941,474 A * 8/1999 Cushing ..... B65H 19/2215 242/530.1
6,007,017 A * 12/1999 Vorwerk ..... B65H 19/126 242/559
6,129,304 A * 10/2000 Biagiotti ..... B26D 3/161 242/530.1

* cited by examiner

AUTOMATIC CORE CHARGING AND BOBBIN DISCHARGING GROUP IN A PLASTIC FILM WINDING MACHINE

The present invention relates to an automatic core-charging and bobbin-discharging group in a plastic film winding machine.

At present, in the field of winding machines of plastic film onto bobbins, one of the most strongly felt problems relates to the flexibility and simplicity of use, with a variation in the processing products, products in this case referring to cores and bobbins.

Current winding machines, in fact, must be capable of winding the film onto variably-sized cores in relation to the final destination of the wound bobbins.

In known winding machines, the flexibility of use is currently subject to human intervention which is the only way of selecting the desired end-product obtained in relation to the setting given to the various elements of the machine.

Human intervention in the various elements to be selected and set can lead to the risk of a possible human error, even if completely unintentional, causing malfunctioning and/or products obtained which do not correspond to the expectations of the users.

It is normal practice in the production of stretch film, for example, to use cardboard cores having the same internal diameter but a different external diameter, therefore cores having different weights and thicknesses.

These cores having different characteristics and dimensions, i.e. having different formats, must be used in the same winding machines.

These changes in format of the cores and bobbins can be linked to both the quantity of film to be wound and also to particular market logics of bobbins.

In relation to the quantity of film, in fact, it is evident that the greater the quantity of film to be wound, the greater the radial crushing resistance of the single core must be. Typically therefore, for larger quantities of film, the outer diameter of the cardboard core onto which the film is wound, must be greater.

With respect to the particular market logics, it should be taken into account whether the sale of the bobbins produced is at gross weight or net weight. The presence and selection of the weight itself of the cardboard core is, in fact, decisive in the presence of this market variable.

On a numerical level, for example, with an internal diameter of the core which is typically 3" (about 76 mm), the external diameter of the same core can indicatively vary from 90 mm to 110 mm.

This variability leads to the necessity of adapting the system for inserting the cores onto the winding reels so that they can take account of said dimensions.

This is currently effected with the intervention of an operator, who sets the machine through appropriate mechanisms which enables the cores having the selected and desired size, to be treated.

In particular, the present state of the art in any case envisages the need for manually moving the automatic charging systems of the cores, which are prevalently composed of linear guide systems having specific grooves in which the cores are deposited. The cores must therefore be conveniently "inserted" in the spindle of the reel prepared for their housing, but the spatial positions of these guides must be previously changed for the specific dimensions of the cores.

This necessity causes time loss and a loss in production, in addition to the need for the presence of operators having a certain specialization.

Analogously, the production of the winding machine can be directed towards finished bobbins having various diameters: typically, bobbins having a diameter ranging from 80 mm to 150 mm called bobbins for "manual" use (produced on 2" reels), or bobbins having a diameter of up to 240 mm for so-called "automatic" use, or again bobbins having a diameter of up to 400 mm for so-called "jumbo" use (the last two products on 3" reels).

The variability in the diameter of the bobbins has a ratio of 5:1, and consequently also in this case requires a discharging and collection system which takes into account the various dimensions and consequently different characteristics of the bobbin produced.

In current machines, this requires the presence of particularly robust and complex mechanisms, which in any case need human intervention for being selected in relation to the type of bobbin to be produced and therefore discharged from the spindle of the reel, and removed therefrom.

As previously specified, said human intervention is the source of slowdowns or stoppages in production with the possible addition of error in one of the numerous calibrating operations that must be effected.

Furthermore, it should also be remembered that the finished bobbins are "extracted" from the spindle of the reel by means of a mechanical arm driven by a linear actuator.

In this operation, an end of the spindle of the reel, although normally held firmly during the winding phase, must be released at the moment of extraction.

At this moment, a bending of the spindle of the reel is caused, which therefore has one end wedged and the other free. This bending, obviously depending on the weight of the bobbins wound, and therefore directly on their diameter, requires a discharging system that attempts to deal with this problem, allowing the bobbins to be moved without being damaging while they are being extracted.

A general objective of the present invention is to solve the above-mentioned drawbacks of the known art in an extremely simple, economical and particularly functional manner.

A further objective of the present invention is to provide an automatic core-charging and bobbin-discharging group in a winding machine of plastic film which avoids, as far as possible, any human intervention.

Another objective of the present invention is to provide an automatic core-charging and bobbin-discharging group which enables the use of cores having different external diameters, without any intervention.

Yet another objective of the present invention is to provide an automatic core-charging and bobbin-discharging group which eliminates or minimizes machine stoppage time for its adaptation.

A further objective of the present invention is to provide an automatic core-charging and bobbin-discharging group suitable for handling bobbins having different outer diameters, without damaging them.

Another objective of the present invention is to provide an automatic bobbin-discharging group which preserves the spindle of the reel cantilever-positioned in the bobbin discharging phase, also in the presence of bobbins having a certain weight.

In view of the above objectives, according to the present invention, an automatic core-charging and bobbin-discharging group in a winding machine of plastic film has been conceived, having the characteristics specified in the enclosed claims.

The structural and functional characteristics of the present invention and its advantages with respect to the known art will appear even more evident from the following description, referring to the enclosed drawings, which, inter alia, show embodiments of an automatic core-charging and bobbin-discharging group in a winding machine of plastic film produced according to the present invention.

Figure 1:
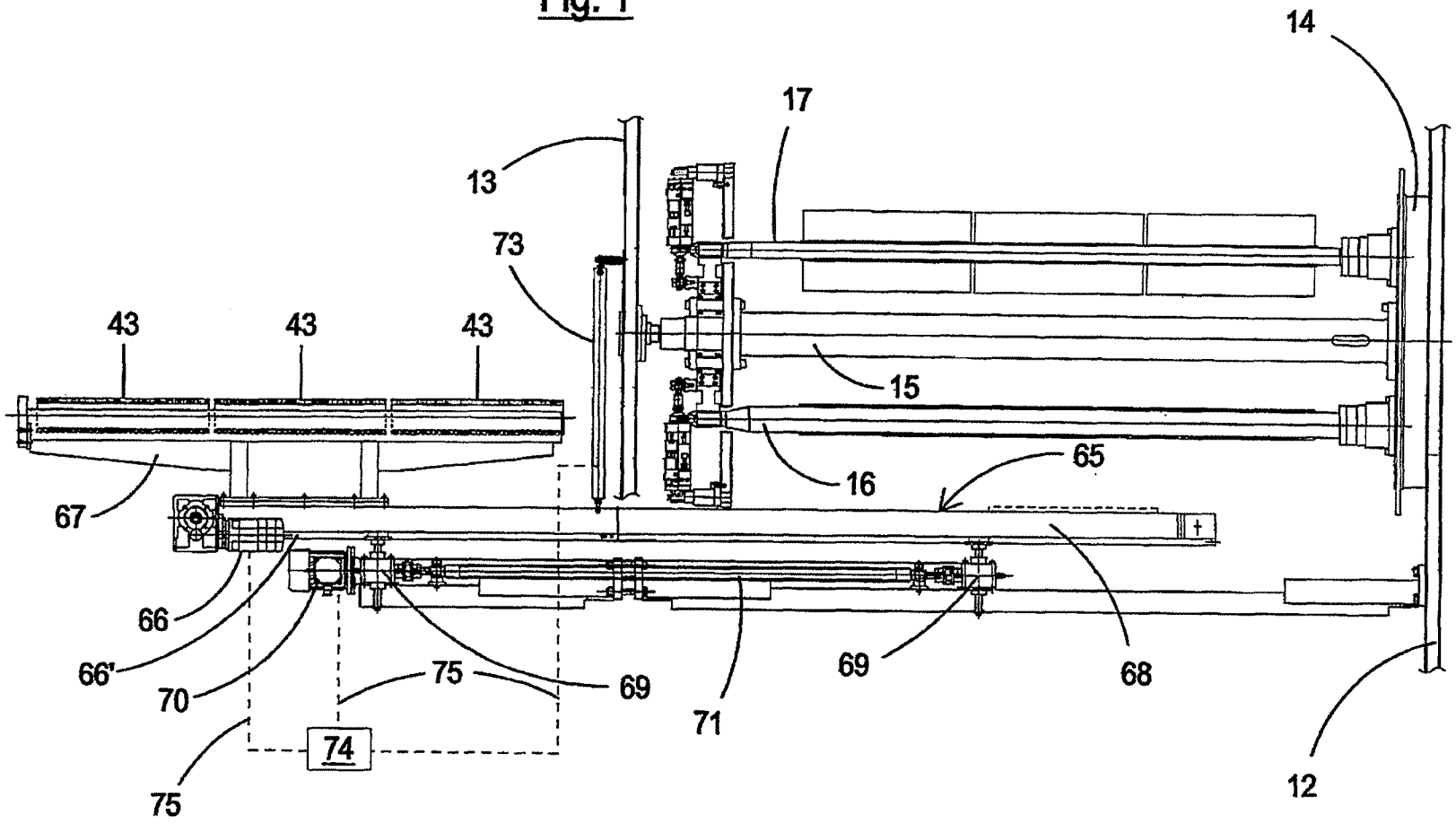
FIG. 1 is a raised schematic front view showing part of a winding machine which comprises an automatic core-charging group produced according to the invention.
Figure 2:
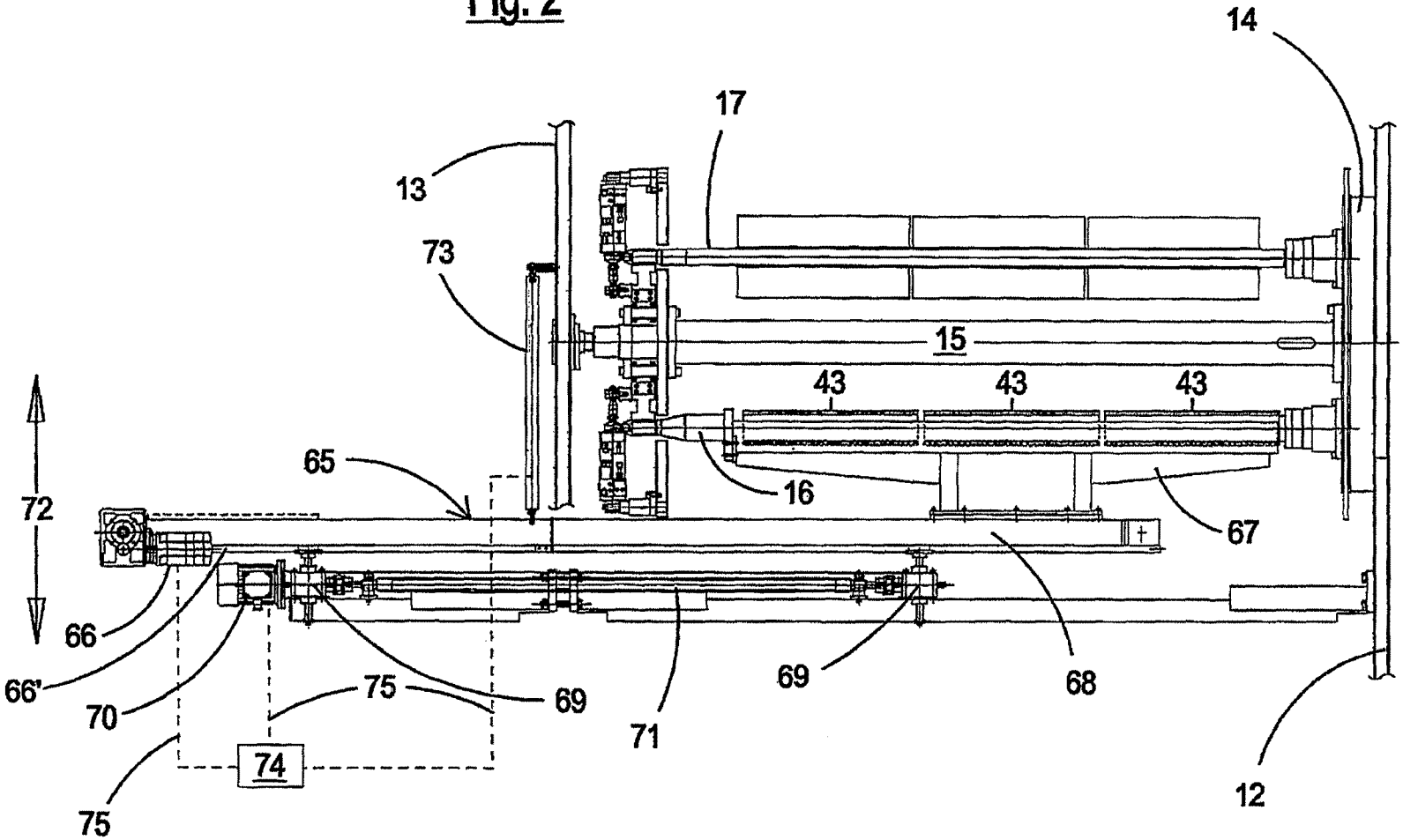
FIG. 2 is a view completely analogous to that of FIG. 1 in a different operative charging phase of the cores.

With reference first of all to FIGS. 1 and 2, these illustrate a raised schematic front view of part of a winding machine in which there is a core-charging and bobbin-discharging group according to the invention.

This group is positioned below and in correspondence with a winding reel.

In particular, the machine in the example comprises two vertical uprights 12, 13, which form its shoulders. A first upright 12 cantilever carries, on a rotating supporting plate 14, a central shaft 15, supported at the other end in correspondence with the second upright 13. The plate 14, rotating around the central shaft 15, also carries three spindles, of which two, 16 and 17, are shown, arranged at 120° with respect to each other, which complete the winding reel.

According to the invention, the core-charging and bobbin-discharging group produced in accordance with the invention, is associated with the reel.

Figure 5:
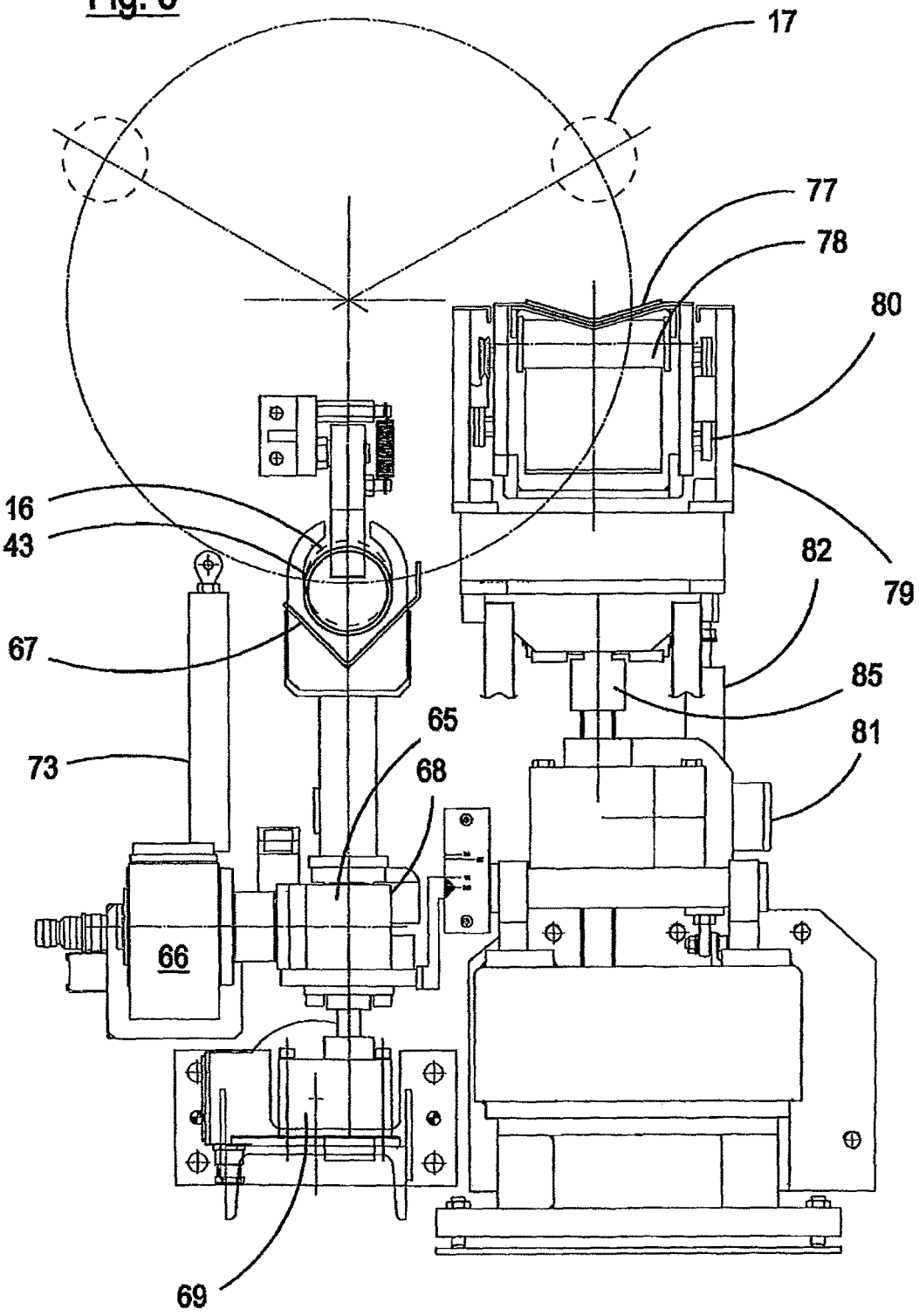
FIG. 5 is a raised schematic side end-view showing both the automatic core-charging group and the automatic bobbin-discharging group according to the invention.

FIGS. 1 and 2 illustrate in particular a portion of core charging 43 which is partly juxtaposed and partly beneath the winding reel (FIG. 5).

In this portion of core charging, the group, as illustrated, is schematically composed of a linear actuator 65 driven by a motor 66, for example frequency controlled, carrying a guide-support 67, movable backwards and forwards, which houses a certain number of cores 43, automatically charged from a warehouse (not shown).

In the example, the linear actuator 65 consists, for example, of an outer casing 68 in which the movable guide-support 67 is driven to slide backwards and forwards in translation. The guide-support 67 has an upper "V"-shaped portion which, in this example, houses three cardboard cores 43.

The outer casing 68 of the linear actuator 65 is in turn supported in correspondence with longitudinal end areas opposite a pair of actuators 69 driven in combination by a side motor 70. In the example, each actuator 69 consists of a jackscrew and the two jackscrews 69 are synchronized by a horizontal bar 71 which rigidly connects them during their movement.

The vertical position of the outer casing 68, and consequently the actuator 65, when lifted, causes the correct alignment and insertion of the cores 43 onto a spindle 16 or 17 of the available reel, in the figure the spindle 16. The vertical lifting position of the actuator 65, according to the arrow 72, is closely linked to the external diameter of the core 43 being used.

As can also be seen in FIGS. 1 and 2, the second motor 70 connected to the pair of jackscrews 69, is controlled in position by a linear potentiometer 73. Said linear potentiometer 73 controls the vertical position of the whole group. This position is automatically calculated and reached on the basis of the external diameter of the core 43 used, which is established by the operator directly on a control panel of the winding machine, schematized in 74 in the figures, making any direct intervention on a mechanical level envisaged in known machines, unnecessary. The control panel 74 is directly connected to both the motors 66 and 70 and to the linear potentiometer 73, as shown by the lines 75.

According to the invention, therefore, in this first portion of the group, the guide-support 67 can be moved backwards and forwards between a position associated with the core charger (not shown) and a position juxtaposed and axially parallel to the spindle 16 or 17 of the winding reel in which the cores 43 are inserted. As already mentioned, the linear actuator 65 can be lifted vertically with a variation in the external diameter of the cores 43 in relation to the diameter of the same 43.

FIG. 1 shows the group in the position of the spindle 16 unloaded and guide-support 67 of the linear actuator 65 that houses three cardboard cores 43.

FIG. 2 shows the group in a charging position of the cores 43. This reveals the necessity of "centering" the guide-support 67 carrying the cores 43 with respect to the spindle 16 of the reel available.

The particular "V"-conformation of the guide-support 67 is practically the only one which is capable of guaranteeing the perfect transversal centering of any type of core 43 with respect to the axis of the spindle of the reel regardless of the diameter of the core.

A variation in the external diameter of the core 43, in fact, imposes a different height of the guide-support 67 for aligning the cores being charged to the spindle 16 which receives them.

The space control is naturally guaranteed by an absolute encoder 66' assembled in axis on the motor 66, which allows the operator to position the cores 43 always centered with respect to the film to be wound, by simply establishing the length and number of the cores 43 from the control panel 74.

In this way, it is sufficient to set, from the control panel 74, the length and number of each core 43 charged; the system then automatically calculates the positioning height necessary with respect to a fixed reference previously established.

The absolute encoder "divides" the length of the linear actuator 65 into "n" sections, and then positions the guide-support 67 with absolute precision in the position calculated.

The present invention therefore completely solves the problems raised, limiting the task of the operator to merely setting, on the control panel 74, the external diameter of the core 43 being used and the number of the same, and also their length.

Figure 3:
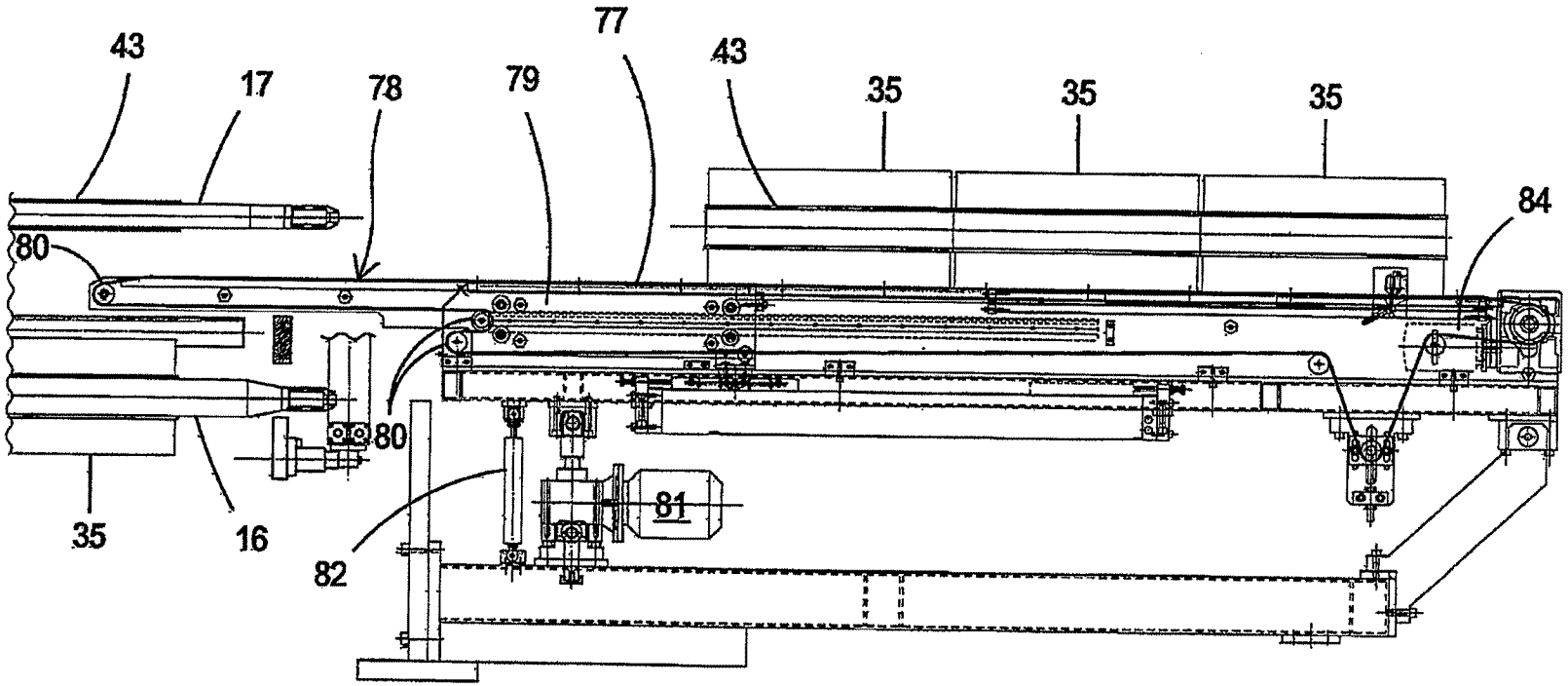
FIG. 3 is a raised schematic front view showing the part of a winding machine in which the part of the automatic bobbin-discharging group produced according to the invention, is arranged.
Figure 4:
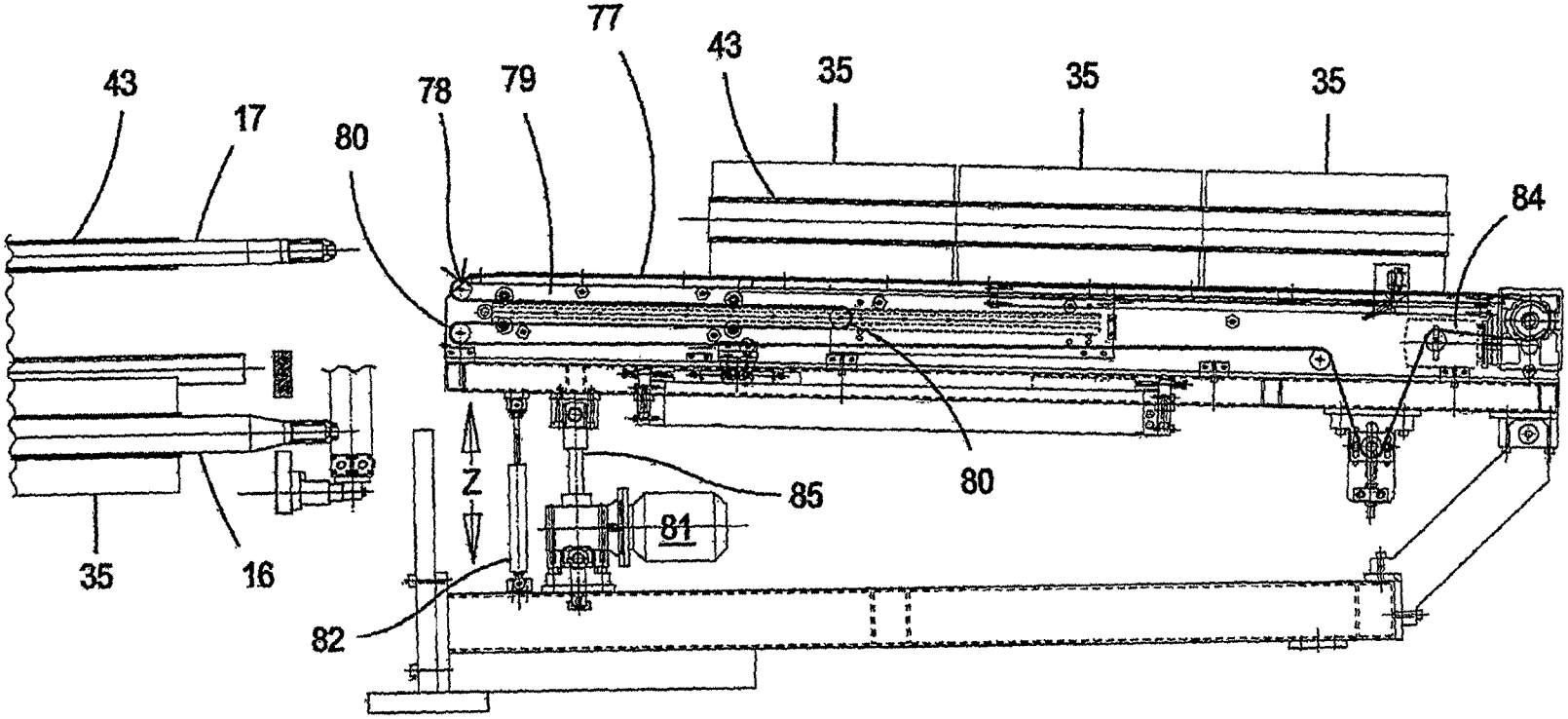
FIG. 4 is a view completely analogous to that of FIG. 3 in a different operative discharging phase of the bobbins.

FIGS. 3 and 4 illustrate in particular, the group of the invention in its discharging portion of bobbins 35 obtained on the cores 43 indicated above and positioned on a spindle 16 or 17 of the winding reel.

This bobbin-discharging portion of the group is essentially arranged juxtaposed with respect to the winding reel (FIG. 5).

In this bobbin-discharging portion, the group, as illustrated, is schematically composed of a conveyor belt 77, motorized by a motor 84. The conveyor belt 77 has an extendable or telescopic portion 78, which can be positioned below the single spindle 16 or 17 carrying all the wound bobbins 35.

The extendable portion 78 of the conveyor belt 77 can be moved backwards and forwards beneath the spindle, thus receiving the bobbins 35 brought onto the spindle 16 or 17 when they are discharged.

In FIG. 3, in fact, it can be noted that the bobbins 35 have been "removed" and discharged from the spindle 16 of the reel by means of a mechanical arm driven by a linear actuator (neither of which are shown or object of the present invention).

The extendable portion 78 is composed, for example, of a movable trolley 79 carrying return rolls 80 of the belt and which allows the backward and forward movement of the extendable part, keeping the belt tensioned and allowing its movement.

The presence of the conveyor belt 77, which, in its expandable portion 78, is positioned beneath the bobbins 35 conveyed, of the spindle 16, prevents excessive bending which can damage the spindle 16 of the reel.

The extendable portion 78 of the conveyor belt 77 is in fact automatically inserted beneath the free end of the spindle 16 of the reel before the same is released from its end support (not shown) and is cantilever-positioned with an automatic operation.

The vertical height of said conveyor belt 77, and consequently its extendable portion 78, is congruent with the final diameter of the bobbins 35 produced therewith for avoiding interference with the same.

As the diameter of the bobbins is determined by a linear potentiometer positioned in another section of the winding machine (not object of this patent), it is used as reference for bringing the conveyor belt 77 to the correct height.

For this purpose, a motor 81 drives a kinematic mechanism 85 and, as it is connected to a linear potentiometer 82, it controls the lifting of the conveyor belt 77 according to the required and desired extent.

It is only at this point that the mechanical arm (not shown) previously indicated, extracts the bobbins 35, "assisted" by the movement of the conveyor belt 77 which rotates, facilitating the extraction and consequently the discharging operation.

After extracting the bobbins 35 from the spindle 16 of the reel, the extendable portion 78 of the conveyor belt 77 is brought back into position. In this case, the space suitable for enabling the tightening of the free end of the spindle of the reel, is freed, for the subsequent winding of new bobbins.

According to the invention, therefore, in this second portion of the discharging group of bobbins 35, the conveyor belt 77, motorized in 84 and equipped with at least one extendable portion 78, can be moved between a position beneath a spindle 16 or 17 carrying the wound bobbins 35 and a discharging portion of the bobbins.

The conveyor belt 77 can be vertically lifted with a variation in the external diameter of the bobbins 35 in relation to the diameter of the same 35.

FIG. 4 shows the phase immediately following the return of the extendable portion 78 of the conveyor belt 77, which, as already mentioned, can also be telescopic.

FIG. 4 illustrates bobbins 35 having different external diameters (smaller than in the previous case of FIG. 3). The difference in the diameter of the bobbins 35 determines a different vertical height of the conveyor belt 77, which is visibly greater in this case, as the diameter of the bobbins is smaller.

The different height is therefore suitable for better synthesizing the vertical movement according to the arrow Z of the conveyor belt 77 effected by the motor 81 and kinematic mechanism 85 and controlled by the linear potentiometer 82.

Consequently, the present invention not only minimizes idle stoppage times, as the intervention, controlled by the control panel, is practically immediate, but also eliminates the variability represented by human intervention on the machine, by automating it.

The automation of the various operations thus obtained, in fact, reduces to the maximum (or even eliminates) the variability otherwise caused by human errors.

All of the objectives mentioned in the preamble of the description have therefore been achieved.

The forms of the structure for producing an automatic core-charging and bobbin-discharging group in a plastic film winding machine according to the invention, as also the materials and assembly modes, can naturally differ from those shown for purely illustrative and non-limiting purposes in the drawings.

The protection scope of the invention is therefore delimited by the enclosed claims.

The invention claimed is:

1. An automatic core charging and reel discharging group in a plastic film winding machine, positioned partially juxtaposed and partially below a winding reel, comprising:

a core charging portion having a motorized (66) linear actuator (65) carrying a guide-support (67) which houses a plurality of cores (43) adapted for receiving a plastic film, said guide-support (67) being movable, backwards and forwards, between a position associated with a core charger and a juxtaposed position, axially parallel to a spindle (16, 17) of the winding reel, with said cores (43) being positioned to be inserted on said spindle (16), wherein said linear actuator (65) is vertically liftable upon a variation in an external diameter of said cores (43); and a bobbin discharging portion (35) having a motorized conveyor belt (77), equipped with at least one extendable portion (78), movable between a position below a spindle (16 or 17) carrying wound bobbins (35) and a discharging portion of said bobbins, said conveyor belt (77) being vertically liftable upon the variation in the external diameter of said cores (35), vertical liftings of said linear actuator (65) and of said conveyor belt (77) being operated by a linear potentiometer (73, 82).

2. The automatic core charging and reel discharging group according to claim 1, wherein said guide-support (67) has a "V"-shaped upper portion.

3. The automatic core charging and reel discharging group according to claim 1, wherein said linear actuator (65) is driven by a frequency-controlled motor (66).

4. The automatic core charging and reel discharging group according to claim 1, wherein said linear actuator (65) is arranged to be vertically lifted a pair of actuators (69) each driven in combination by a respective motor (70).

5. The automatic core charging and reel discharging group according to claim 4, wherein each actuator (69) comprises a jackscrew, the two jackscrews (69) being synchronized by a horizontal bar (71) which rigidly connects the two jackscrews during a movement thereof.

6. The automatic core charging and reel discharging group according to claim 4, further comprising a control panel (74), directly connected to the motors (66, 70) operatively coupled to the linear actuator and the pair of actuators, and also to the linear potentiometer (73).

7. The automatic core charging and reel discharging group according to claim 6, wherein space control is guaranteed by an absolute encoder assembled on an axis on the motor (66) operatively coupled to the linear actuator, such to enable an operator to position the cores (43) always centered with respect to the film, by simply establishing length and number of the cores (43) from the control panel (74).

8. The automatic core charging and reel discharging group according to claim 1, wherein said extendable portion (78) of said conveyor belt (77) comprises a movable trolley (79) which carries return rolls (80) of the conveyor belt and which allows a backward and forward movement of the extendable portion, keeping the conveyor belt tensioned and allowing a movement of the conveyor belt.

9. The automatic core charging and reel discharging group according to claim 1, wherein said conveyor belt (77) is arranged to be vertically lifted, by having said conveyor belt connected to a kinematic mechanism (85) driven by a motor (81) connected to said linear potentiometer (82) which operates the vertical lifting of the conveyor belt (77).

* * * * *